US008624811B2

(12) United States Patent
Kim et al.

(10) Patent No.: US 8,624,811 B2
(45) Date of Patent: Jan. 7, 2014

(54) PANEL ASSEMBLY AND DISPLAY APPARATUS HAVING THE SAME

(75) Inventors: Joo-Hwan Kim, Asan-si (KR); Cheal-Gi Kim, Yongin-si (KR); Min-Sung Choi, Cheonan-si (KR)

(73) Assignee: Samsung Display Co., Ltd., Yongin (KR)

( * ) Notice: Subject to any disclaimer, the term of this patent is extended or adjusted under 35 U.S.C. 154(b) by 1261 days.

(21) Appl. No.: 12/472,159

(22) Filed: May 26, 2009

(65) Prior Publication Data

US 2010/0073354 A1 Mar. 25, 2010

(30) Foreign Application Priority Data

Sep. 22, 2008 (KR) ..... 10-2008-0092517

(51) Int. Cl.
*G09G 3/36* (2006.01)

(52) U.S. Cl.
USPC ..... 345/87; 345/100; 345/204

(58) Field of Classification Search
USPC ..... 345/87–104, 204
See application file for complete search history.

(56) References Cited

U.S. PATENT DOCUMENTS

| | | | | |
|---|---|---|---|---|
| 6,246,385 | B1 * | 6/2001 | Kinoshita et al. | 345/87 |
| 6,894,667 | B1 * | 5/2005 | Lin | 345/87 |
| 2004/0263447 | A1 * | 12/2004 | Hong et al. | 345/87 |
| 2007/0040795 | A1 * | 2/2007 | Lee et al. | 345/100 |

FOREIGN PATENT DOCUMENTS

| | | |
|---|---|---|
| JP | 2007140393 | 6/2007 |
| KR | 1020050011902 | 1/2005 |
| KR | 1020070120741 | 12/2007 |

* cited by examiner

*Primary Examiner* — Michael Pervan
(74) *Attorney, Agent, or Firm* — H.C. Park & Associates, PLC

(57) ABSTRACT

A panel assembly includes a display panel and a panel driving apparatus. The display panel includes a data line and a gate line extended in a direction that crosses the data line. The panel driving apparatus includes a first gate driving circuit that outputs a first gate signal to the gate line, and a second gate driving circuit disposed in an area that corresponds to an inverter and that outputs a second gate signal to the gate line, the second gate signal being different from the first gate signal.

20 Claims, 7 Drawing Sheets

PANEL ASSEMBLY AND DISPLAY APPARATUS HAVING THE SAME

CROSS REFERENCE TO RELATED APPLICATION

This application claims priority from and the benefit of Korean Patent Application No. 2008-92517, filed on Sep. 22, 2008, which is hereby incorporated by reference for all purposes as if fully set forth herein.

BACKGROUND OF THE INVENTION

1. Field of the Invention

The present invention relates to a panel assembly and a display apparatus having the panel assembly. More particularly, the present invention relates to a panel assembly for improving luminance deviation, and a display apparatus having the panel assembly.

2. Discussion of the Background

Generally, liquid crystal display (LCD) apparatuses have small thickness, light weight, and low power consumption, and may be used for large televisions as well as monitors, laptop computers, and cellular phone displays. An LCD apparatus includes an LCD panel and a backlight assembly. The LCD panel displays an image using a liquid crystal, which transmits light depending on an applied electric field. The backlight assembly is disposed under the LCD panel and provides light to the LCD panel.

The backlight assembly includes a lamp that generates light, a socket electrically connected to an electrode of the lamp, a receiving container that receives the lamp and the socket, and an inverter electrically connected to the socket and that applies a driving current to the lamp. The inverter is disposed on one side or both sides of a bottom surface of the receiving container.

A hot electrode of the lamp that corresponds to an area in which the inverter is disposed has a tube current of about 10 mA, and a cold electrode of the lamp that corresponds to an area opposite to the area in which the inverter is disposed has a tube current of about 9 mA. Thus, current deviation may be caused by the inverter, and luminance deviation in the LCD may be caused by the current deviation.

SUMMARY OF THE INVENTION

The present invention provides a panel assembly to enhance luminance uniformity.

The present invention also provides a display apparatus having the above-mentioned panel assembly.

Additional features of the invention will be set forth in the description which follows, and in part will be apparent from the description, or may be learned by practice of the invention.

The present invention discloses a panel assembly that includes a display panel and a panel driving apparatus. The display panel includes a data line and a gate line extended in a direction that crosses the data line. The panel driving apparatus includes a first gate driving circuit that outputs a first gate signal to the gate line, and a second gate driving circuit disposed in an area that corresponds to an inverter and that outputs a second gate signal to the gate line, the second gate signal being different from the first gate signal.

The present invention also discloses a panel assembly that includes a display panel and a panel driving apparatus. The display panel includes a data line and a gate line extended in a direction that crosses the data line. The panel driving apparatus includes a first gate driving circuit that outputs a first gate signal having a first high level to the gate line, and a second gate driving circuit disposed in an area that corresponds to an inverter and that outputs a second gate signal of a second high level to the gate line, the second high level of the second gate signal being lower than the first high level of the first gate signal.

The present invention also discloses a display apparatus that includes a backlight assembly and a panel assembly. The backlight assembly includes a receiving container that receives a light source, and an inverter disposed on the rear surface of the receiving container and that provides driving power to the light source. The panel assembly includes a display panel having a data line and a gate line extended in a direction that crosses the data line, a first gate driving circuit that outputs a first gate signal to the gate line, and a second gate driving circuit disposed in an area that corresponds to the inverter and that outputs a second gate signal to the gate line, the second gate signal being different from the first gate signal.

The present invention also discloses a display apparatus that includes a backlight assembly and a panel assembly. The backlight assembly includes a receiving container that receives a light source, and an inverter disposed on the rear surface of the receiving container and that provides driving power to the light source. The panel assembly includes a first gate driving circuit that outputs a first gate signal having a first high level to the gate line, and a second gate driving circuit disposed in an area that corresponds to the inverter and that outputs a second gate signal of a second high level to the gate line, the second high level of the second gate signal being lower than the first high level of the first gate signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF THE ILLUSTRATED EMBODIMENTS

Figure 1:
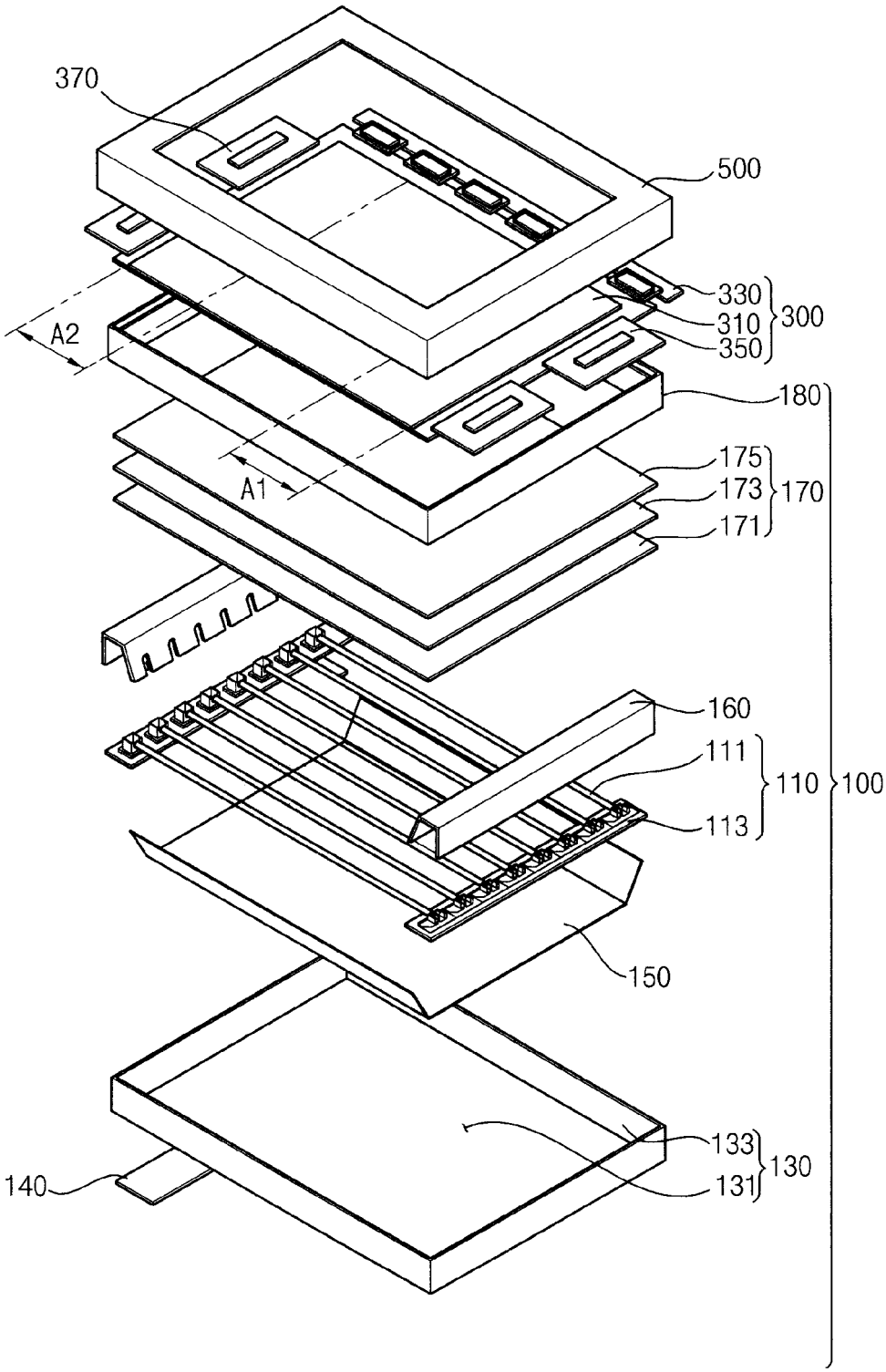
FIG. 1 is an exploded perspective view schematically showing a display apparatus according to a first exemplary embodiment of the present invention.

The present invention is described more fully hereinafter with reference to the accompanying drawings, in which exemplary embodiments of the present invention are shown. The present invention may, however, be embodied in many different forms and should not be construed as limited to the exemplary embodiments set forth herein. Rather, these exemplary embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular exemplary embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Exemplary embodiments of the invention are described herein with reference to cross-sectional illustrations that are schematic illustrations of idealized exemplary embodiments (and intermediate structures) of the present invention. As such, variations from the shapes of the illustrations as a result, for example, of manufacturing techniques and/or tolerances, are to be expected. Thus, exemplary embodiments of the present invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in detail with reference to the accompanying drawings.

FIG. 1 is an exploded perspective view schematically showing a display apparatus according to a first exemplary embodiment of the present invention.

Referring to FIG. 1, the display apparatus includes a backlight assembly 100, a panel assembly 300, and a top chassis 500.

The backlight assembly 100 is disposed toward the rear surface of the panel assembly 300, and provides light to the panel assembly 300.

The backlight assembly 100 includes a lamp module 110, a receiving container 130, an inverter 140, a reflective plate 150, a side mold 160, an optical member 170 and a mold frame 180. The lamp module 110 includes a lamp 111 and a lamp socket 113. The lamp 111 includes a lamp tube that generates light and electrodes disposed at both sides of the lamp tube to receive power. The lamp socket 113 is connected to electrodes of the lamp to supply the lamp 111 with the power. The receiving container 330 includes a bottom surface 131 that defines a receiving space and a plurality of side walls 133 extended from the bottom surface 131. The lamp module 110 is received in the receiving space of the receiving container 130.

The inverter 140 is electrically connected to the lamp socket 113 to supply the lamp socket 113 with power. The inverter 140 is disposed on one side of the rear surface of the bottom surface 131. The lamp 111 includes a hot electrode and a cold electrode, and the inverter 140 may be disposed in an area corresponding to the hot electrode.

The reflective plate 150 is disposed between the bottom surface 131 and the lamp 111 to reflect light toward the panel assembly 300. The side mold 160 is disposed on both ends of the lamp 111 to fix the receiving container 130 with the lamp module 110. The side mold 160 has a predetermined height to support the optical member 170. The optical member 170 is disposed between the panel assembly 300 and the lamp module 110 to enhance the efficiency of light generated from the lamp 111. The optical member 170 may include a diffusion sheet 171, a prism sheet 173, and a protective sheet 175.

The mold frame 180 is disposed in the lower portion of the panel assembly 300 to support the panel assembly 300. The mold frame 180 is disposed in the upper portion of the optical member 170 and the mold frame 180 may be fixed on the side mold 160 with the optical member 170.

The panel assembly 300 includes a display panel 310, a source module 330, a first gate module 350 and a second gate module 370. The display panel 310 includes a plurality of pixels, and each of the pixels is electrically connected to and driven by a gate line and a data line. The source module 330 is disposed on a first side of the display panel 310, and the source module 330 generates a data signal to output the data signal to the data line of the display panel 310.

The first gate module 350 is disposed on a second side of the display panel 310 adjacent to the source module 330, and the first gate module 350 generates a first gate signal to output the first gate signal to the gate line of the display panel 310.

The second gate module 370 is disposed on a third side of the display panel 310 opposite to the first gate module 350, and the second gate module 370 generates a second gate signal and outputs the second gate signal to the gate line of the display panel 310. The second gate module 370 is disposed corresponding to an area in which the inverter 140 is disposed. The gate line is driven by a dual gate mode, by which the first and second gate modules 350 and 370 output the first and second gate signals to one gate line at the same time.

The second gate signal may be different from the first gate signal. For example, a high level of the second gate signal may be lower than a high level of the first gate signal. Alternatively, the second gate signal may have a second slice that pulls down the second gate signal from the high level of the second gate signal to a predetermined level, and the first gate signal may have a first slice that pulls down the first gate signal from the high level of the first gate signal to the predetermined level. The width of the second slice may be larger than the width of the first slice.

When the same data voltage is applied to the pixels in a first area Al adjacent to the first gate module 350 and the pixels in a second area A2 adjacent to the second gate module 370, the pixels in the first area A1 may be charged to a first pixel voltage by the first gate signal and the pixels in the second area A2 may be charged to a second pixel voltage lower than the first pixel voltage by the second gate signal. The pixels in the second area A2 corresponding to the inverter 140 display an image of a lower luminance than the pixels of the first area A1 so that the luminance deviation between the first and second areas A1 and A2 caused by the inverter 140 may be removed.

The top chassis 500 is disposed in the upper portion of the panel assembly 300 and is coupled with the receiving container 130. The top chassis 500 has an opening that exposes a display area of the display panel 310.

Figure 2:
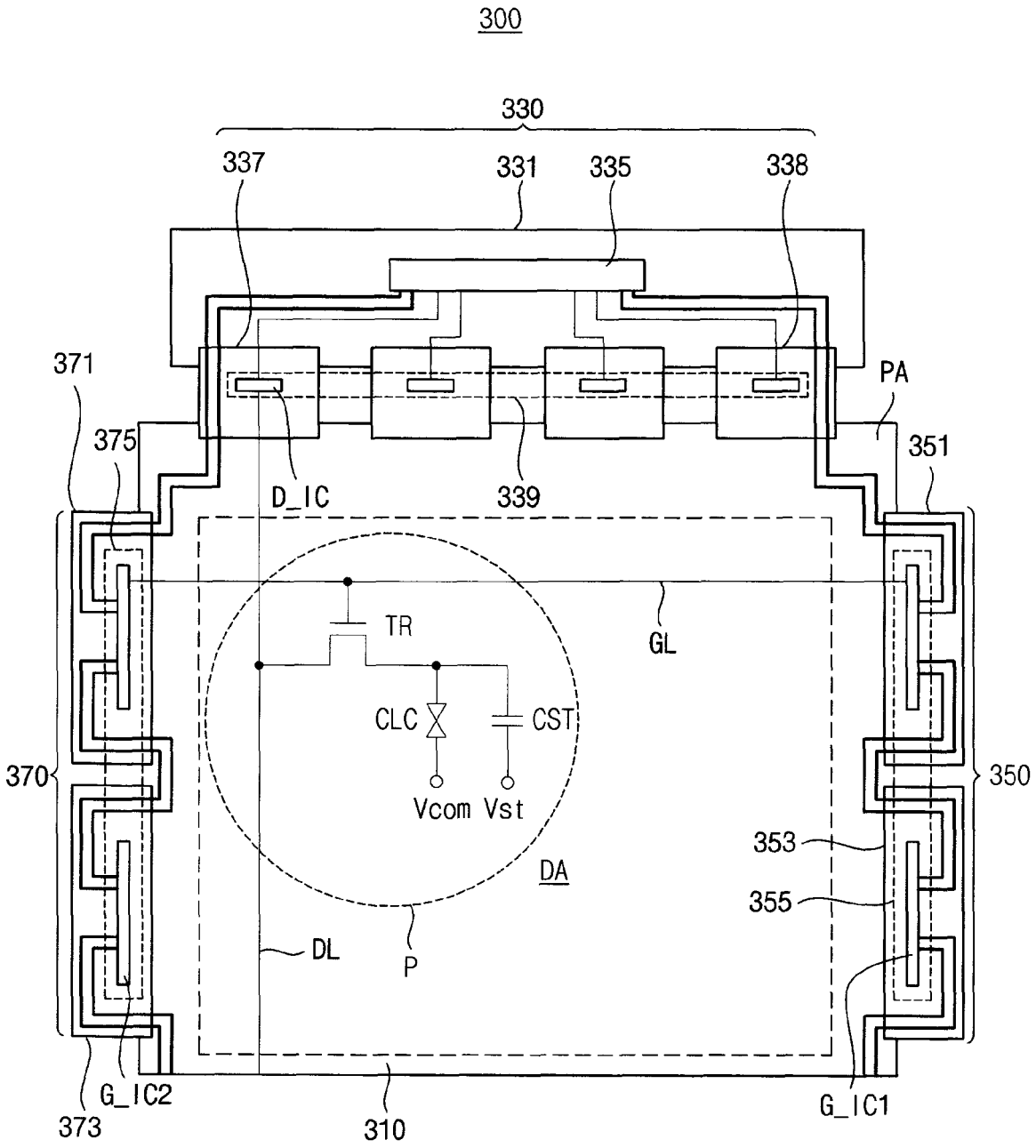
FIG. 2 is a plan view schematically showing the panel assembly of FIG. 1.

FIG. 2 is a plan view schematically showing the panel assembly of FIG. 1.

Referring to FIG. 1 and FIG. 2, the panel assembly 300 includes a display panel 310, a source module 330, a first gate module 350, and a second gate module 370.

The display panel 310 includes a data line DL, a gate line GL, and a pixel P. The pixel P includes a switching element TR, a liquid crystal capacitor CLC, and a storage capacitor CST. The switching element TR is connected to the data line DL and the gate line GL. The liquid crystal capacitor CLC includes a first end connected to an output electrode of the switching element TR and a second end receiving a first common voltage Vcom. The storage capacitor CST includes a first end connected to the first end of the liquid crystal capacitor CLC and a second end receiving a second common voltage Vst.

The source module 330 includes a source printed circuit board (PCB) 33 1, a main circuit part 335, and a plurality of source tape carrier packages (TCPs) 337 and 338. The main circuit part 335 is disposed on the source PCB 331. Alternatively, the main circuit part 335 may be disposed on a special PCB electrically connected to the source PCB 331 and the main circuit part 335 may be electrically connected to the source TCPs 337 and 338 by using a plurality of flexible printed circuit board (FPCBs) (not shown).

The main circuit part 335 includes a timing control part and a voltage generating part. The main circuit part 335 receives a synchronization signal, an image signal, and power from the exterior. The main circuit part 335 generates a plurality of timing control signals by using the synchronization signal, and generates a plurality of driving voltages by using the power. The timing control signals include a vertical starting signal STV, a gate clock signal CPV, a gate enable signal OE, etc., provided to the first and second gate modules 350 and 370. The driving voltages includes a gate on voltage Von, a gate off voltage Voff, etc., provided to the first and second gate modules 350 and 370.

Each of the source TCPs 337 and 338 has a data driving chip D_IC and electrically connects the main circuit part 335 with the data driving chip D_IC. The data driving chip D_IC converts the image signal received from the main circuit part 335 into an analog data signal to output the data signal to the data line DL. A first source TCP 337 adjacent to the first gate module 350 among the source TCPs 337 and 338 may further include a dummy line electrically connecting the main circuit part 335 with the first gate module 350. In addition, a last source TCP 338 among the source TCPs 337 and 338 may further include a dummy line electrically connecting the main circuit part 335 with the second gate module 370. Alternatively, the main circuit part 335 may be electrically connected to the first and second gate modules 350 and 370 through an FPCB (not shown).

The first gate module 350 includes a plurality of first gate TCPs 351 and 353. Each of the first gate TCPs 351 and 353 has a first gate driving chip G_IC1. The first gate driving chip G_IC1 generates a first gate signal G1 by using the gate on and off voltages Von and Voff transmitted through the dummy line of the last source TCP 338 and the gate control signals. The first gate driving chip G_IC1 generates a plurality of first gate signals to sequentially output the first gate signals to a plurality of gate lines. The first gate driving chip G_IC1 may be disposed on the display panel 31 0, or may be directly formed on the display panel 310 through the same processes for forming the switching element included in the pixel P.

The second gate module 370 includes a plurality of second gate TCPs 371 and 373. Each of the second gate TCPs 371 and 373 has a second gate driving chip G_IC2. The second gate driving chip G_IC2 generates a second gate signal G2 by using the gate on and off voltages Von and Voff transmitted through the dummy line of the first source TCP 337 and the gate control signals. The second gate driving chip G_IC2 generates a plurality of second gate signals to sequentially output the second gate signals to a plurality of gate lines. The second gate driving chip G_IC2 may be disposed on the display panel 3 10, or may be directly formed on the display panel 310 through the same processes for forming the switching element included in the pixel P.

The first gate signal G1 generated from the first gate driving chip G_IC1 is different from the second gate signal G2 generated from the second gate driving chip G_IC2. For example, a high level of the second gate signal G2 may be lower than a high level of the first gate signal G1. Alternatively, the second gate signal may have a second slice that pulls down the second gate signal from the high level of the second gate signal to a predetermined level, and the first gate signal may have a first slice that pulls down the first gate signal from the high level of the first gate signal to the predetermined level. The width of the second slice may be larger than the width of the first slice.

When the same data voltage is applied to the pixels in a first area A1 adjacent to the first gate module 350 and the pixels in a second area A2 adjacent to the second gate module 370, the pixels in the first area A1 may be charged to a first pixel voltage by the first gate signal and the pixels in the second area A2 may be charged to a second pixel voltage lower than the first pixel voltage by the second gate signal. The pixels of the second area A2 corresponding to the inverter 140 display an image of a lower luminance than the pixels of the first area A1 so that the luminance deviation between the first and second areas A1 and A2 caused by the inverter 140 may be removed.

Figure 3:
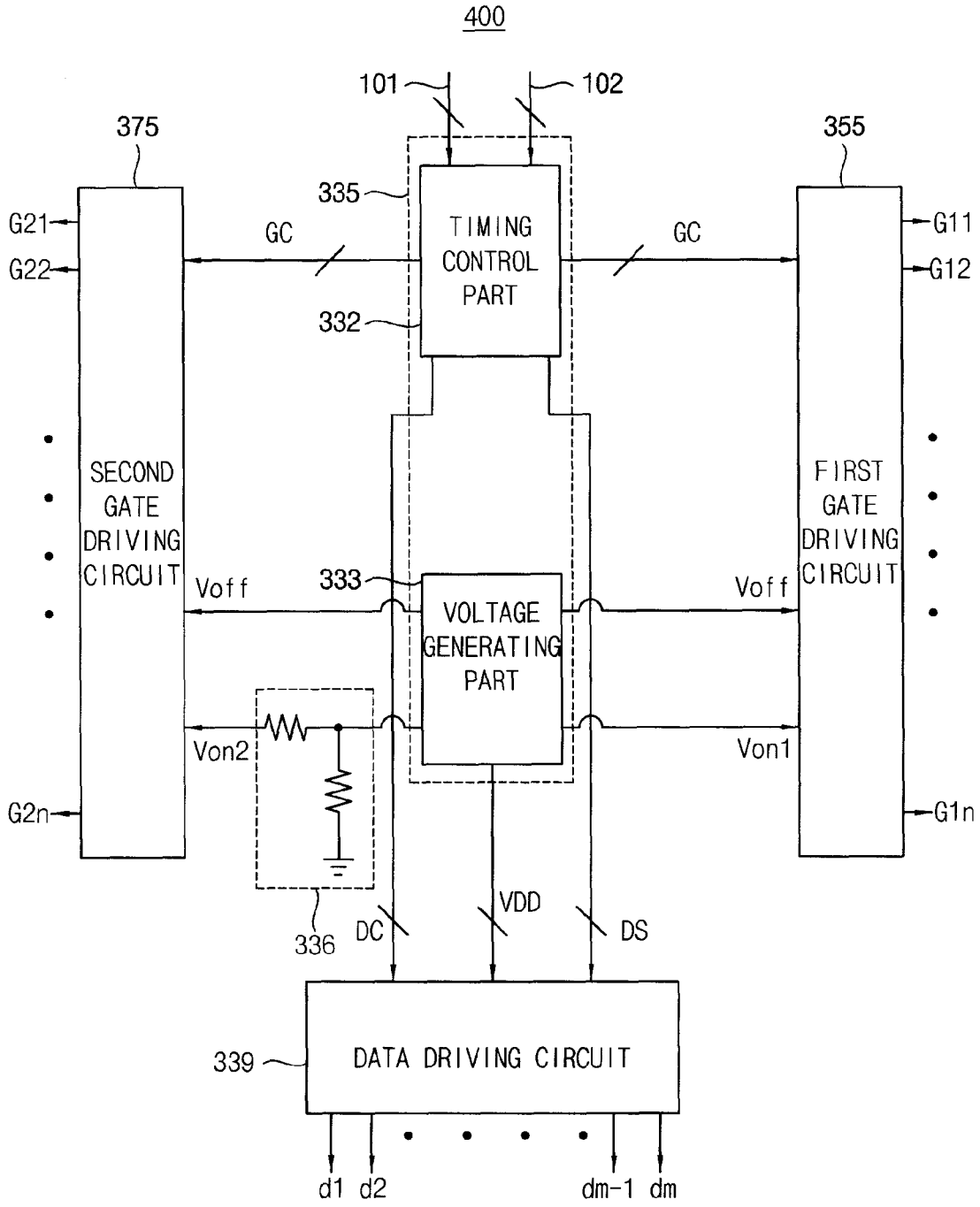
FIG. 3 is a block diagram showing a panel driving apparatus of the panel assembly of FIG. 2.

FIG. 3 is a block diagram showing a panel driving apparatus of the panel assembly of FIG. 2.

Referring to FIG. 2 and FIG. 3, the panel assembly 300 includes the display panel 310 and a panel driving apparatus for driving the display panel 310.

The panel driving apparatus 400 includes a main circuit part 335, a voltage dividing part 336, a data driving circuit 339, a first gate driving circuit 355 and a second gate driving circuit 375.

The main circuit part 335 includes a timing control part 332 and a voltage generating part 333. The timing control part 332 receives a synchronization signal 101 and an image signal 102 from the exterior. The timing control part 332 generates a plurality of timing control signals for driving the display panel 310 by using the synchronization signal 101. The timing control signals includes a data control signal DC for driving the data driving circuit 339 and a gate control signal GC for driving the first and second gate driving circuits 355 and 375. The data control signal DC includes a horizontal start signal STH, a data clock signal, etc. The gate control signal GC includes a vertical start signal STV, a gate clock signal CPV, etc. The timing control part 335 modifies the image signal 102 into a data signal DS modified corresponding to a resolution of the display panel 310 to output the data signal DS to the data driving circuit 339.

The voltage generating part 333 generates a plurality of driving voltages for driving the display panel 310. The driving voltages includes a power supply voltage VDD for driving the data driving circuit 339, a first gate on voltage Von1 and a gate off voltage Voff for driving the first and second gate driving circuits 355 and 375. The first gate on voltage Von1 has a first high level.

The voltage dividing part 336 is disposed between the voltage generating part 333 and the second gate driving circuit 355. The voltage dividing part 336 divides the first gate on voltage Von1 into a second gate on voltage Von2 and a predetermined voltage, and outputs the second gate on voltage Von2 having a second high level lower than the first high level to the second gate driving circuit 355.

The data driving circuit 339 converts the data signal DS into an analog data voltage 'd' based on the data control signal DS to output the data voltage d to the data line DL of the display panel 310. For example, the data driving circuit 339 outputs m data voltages d1, d2, . . . , dm-1, dm according to the display panel 310 having a resolution of m×n.

The first gate driving circuit 355 generates the first gate signal G1 based on the gate control signal GS by using the first gate on voltage Von1 and the gate off voltage Voff The first gate signal G1 is a pulse signal having the first high level of the first gate on voltage Von1. For example, the first gate driving circuit 355 generates n first gate signals G11, G12, . . . , G1*n* to sequentially output the n first gate signals G11, G12, . . . , G1*n*.

The second gate driving circuit 375 generates the second gate signal G2 based on the gate control signal GS by using the second gate on voltage Von2 and the gate off voltage Voff The second gate signal G2 is a pulse signal having the second high level of the second gate on voltage Von2. For example, the second gate driving circuit 357 generates n second gate signals G21, G22, . . . , G2*n* to sequentially output the n second gate signals G21, G22, . . . , G2*n*.

Figure 4:
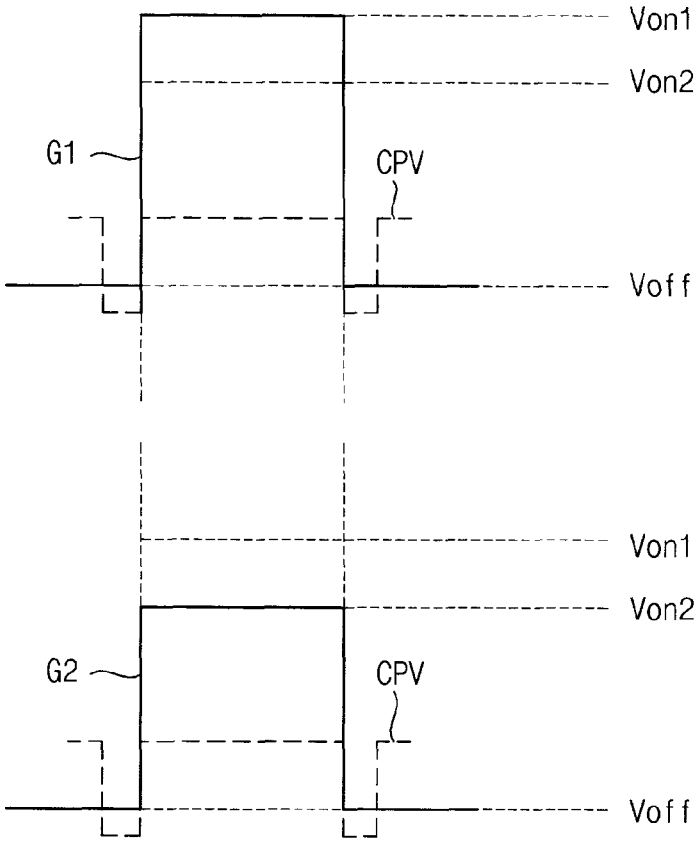
FIG. 4 is timing diagrams showing input and output signals of the first and second driving circuits of FIG. 3.

FIG. 4 are timing diagrams showing input and output signals of the first and second driving circuits of FIG. 3.

Referring to FIG. 3 and FIG. 4, the first gate driving circuit 355 generates the first gate signal G1 based on the gate clock signal CPV by using the first gate on voltage Von1 and the gate off voltage Voff The second gate driving circuit 375 generates the second gate signal G2 based on the gate clock signal CPV by using the second gate on voltage Von2 and the gate off voltage Voff.

The first gate driving circuit 355 generates the pulse signal having a set pulse width based on the synchronization of the gate clock signal CPV. A high level of the pulse signal is determined by a level of the first gate on voltage Von1 and a low level of the pulse signal is determined by a level of the gate off voltage Voff.

The second gate driving circuit 375 generates the pulse signal having a set pulse width based on the synchronization of the gate clock signal CPV. A high level of the pulse signal is determined by a level of the second gate on voltage Von2 and a low level of the pulse signal is determined by a level of the gate off voltage Voff.

Thus, the first gate driving circuit 355 generates the first gate signal G1 having the first high level corresponding to the level of the first gate on voltage Von1. The second gate driving circuit 375 generates the second gate signal G2 having the second high level corresponding to the level of the second gate on voltage Von2.

When a level of the gate signal received in a gate electrode of the switching element TR is higher, a current flowing between a source electrode and a drain electrode of the switching element TR increases. Thus, the liquid crystal capacitor CLC connected to the drain electrode of the switching element TR is charged with a high voltage, when the level of the gate signal is higher.

Therefore, the first and second gate signals G1 and G2 are controlled differently from each other in the high level, so that the pixels corresponding to a first area in which the inverter 140 is disposed are driven to have a lower luminance than the pixels in a second area opposite to the first area. Thus the luminance deviation caused by the inverter 140 may be removed.

Figure 5:
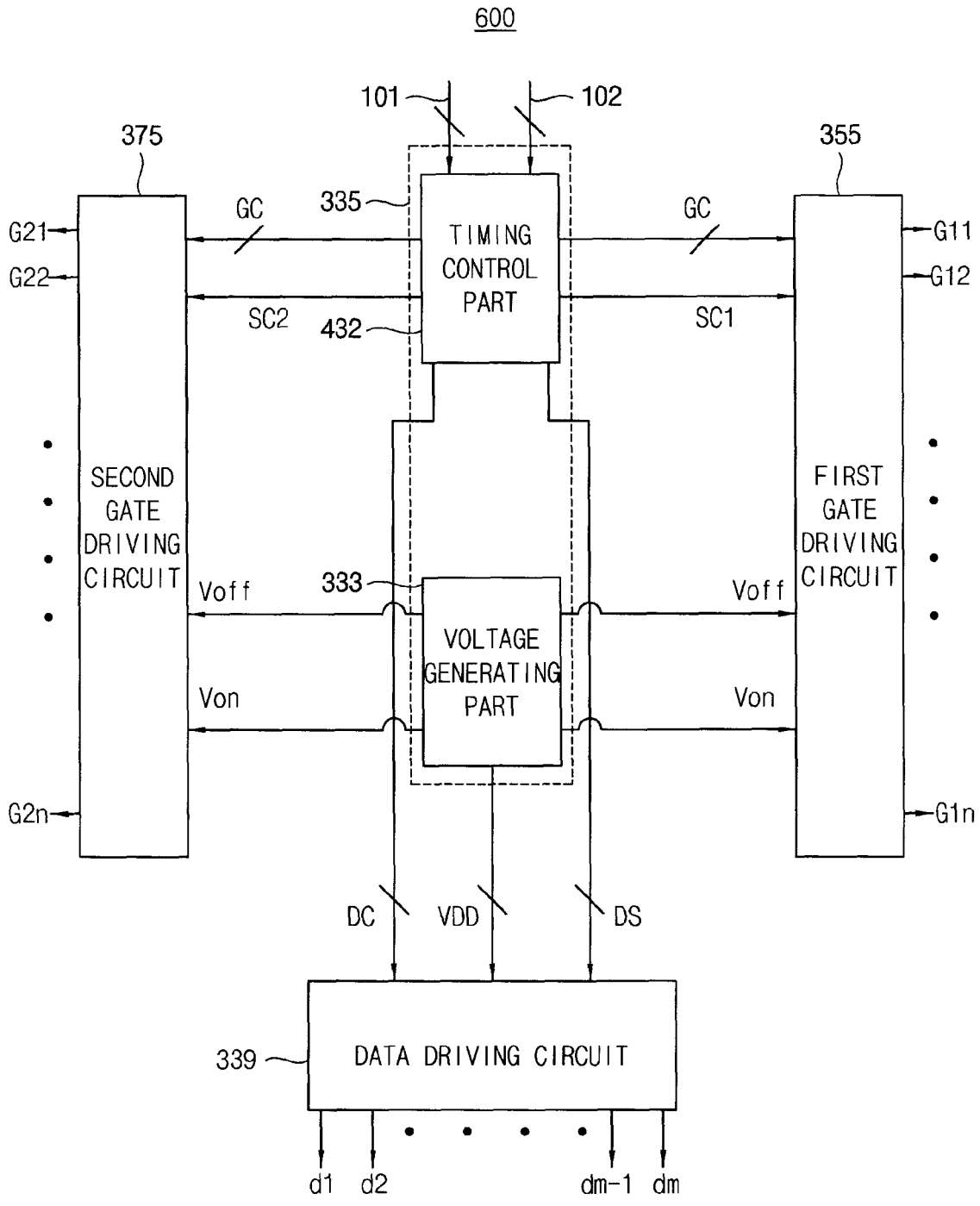
FIG. 5 is a block diagram showing a panel driving apparatus of a panel assembly according to a second exemplary embodiment of the present invention.

FIG. 5 is a block diagram showing a panel driving apparatus of the panel assembly according to a second exemplary embodiment of the present invention. Hereinafter, the same reference numerals will be used to refer to the same or like parts as those described in the panel assembly according to the first exemplary embodiment, and any further repetitive explanation concerning the above elements will be omitted.

Referring to FIG. 2 and FIG. 5, the panel assembly 300 includes a display panel 310 and a panel driving apparatus 600 for driving the display panel 310.

The panel driving apparatus 600 includes a main circuit part 335, a data driving circuit 339, a first gate driving circuit 355 and a second gate driving circuit 375.

The main circuit part 335 includes a timing control part 432 and a voltage generating part 333. The timing control part 432 generates a plurality of timing control signals for driving the display panel 310 by using the synchronization signal 101. The timing control signals includes a data control signal DC and a gate control signal GC. The gate control signal GC includes a vertical start signal STV, a first slice signal SC1 and a second slice signal SC2, etc.

The voltage generating part 333 generates a power supply voltage VDD, a gate on voltage Von and a gate off voltage Voff.

The first gate driving circuit 355 generates a first gate signal G1 having a first slice width CW1 set based on the first slice signal SC1. The first slice width CW1 corresponds to a first interval, and the first gate signal G1 is pulled down from a high level of the gate on voltage Von to a kickback voltage Vkb in the first interval. The kickback voltage Vkb is predetermined. The first gate driving circuit 355 generates n first gate signals G11, G12, . . . , G1*n* to sequentially output the n first gate signals G11, G12, . . . , G1*n*.

The second gate driving circuit 375 generates a second gate signal G2 having a second slice width CW2 set based on the second slice signal SC2. The second slice width CW2 corresponds to a second interval and the second gate signal G2 is pulled down from a high level of the gate on voltage Von to the kickback voltage Vkb in the second interval. The second slice width CW2 is larger than the first slice width CW1. The second gate driving circuit 375 generates n second gate signals G21, G22, . . . , G2*n* to sequentially output the n second gate signals G21, G22, . . . , G2*n*.

Figure 6:
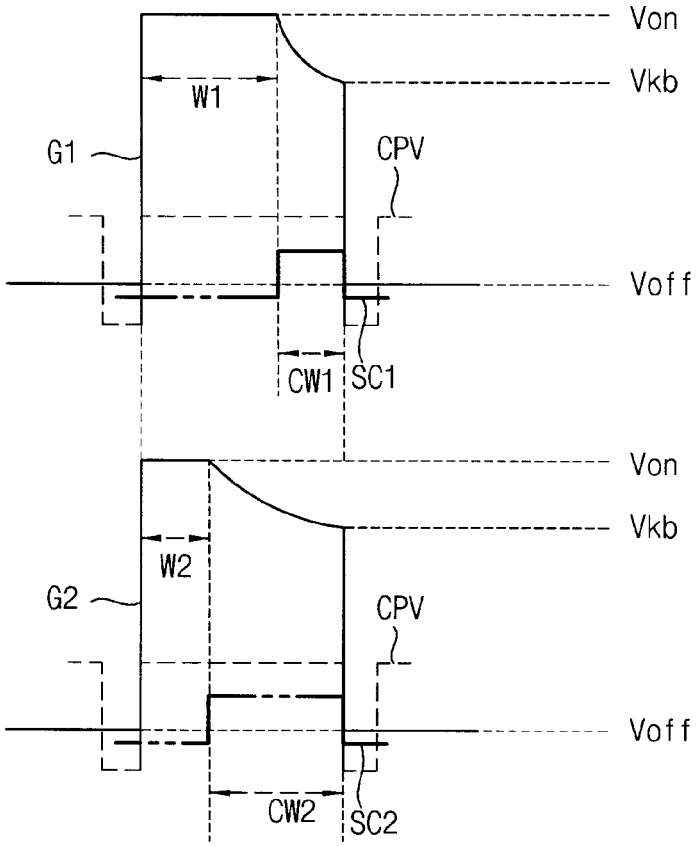
FIG. 6 is timing diagrams showing input and output signals of the first and second driving circuits of FIG. 5.

FIG. 6 are timing diagrams showing input and output signals of the first and second driving circuits of FIG. 5.

Referring to FIG. 5 and FIG. 6, the first gate driving circuit 355 outputs a first gate signal G1 which holds the gate on voltage Von during an interval corresponding to the first width W1 of the gate pulse width, and pulls down the first gate signal G1 from the gate on voltage Von to the kickback voltage Vkb during a remaining interval of the gate pulse width. Thus, the first gate signal G1 includes a first slice based on the synchronization of the first slice signal SC1.

The first gate driving circuit 355 generates a pulse signal having the gate pulse width based on the synchronization of the gate clock signal CPV. The high level of the pulse signal corresponds to the gate on voltage Von, and the low level of the pulse signal corresponds to the gate off voltage Voff The first gate driving circuit 355 pulls down the pulse signal from the high level of the pulse signal to the kickback voltage Vkb in response to the first slice SC1. Thus, the first gate signal G1 comprises the high level of the first width W1 and the first slice of the first slice width CW1.

The second gate driving circuit 375 outputs a second gate signal G2 which holds the gate on voltage Von during an interval corresponding to the second width W2 of the gate pulse width and pulls down the second gate signal G2 from the gate on voltage Von to the kickback voltage Vkb during a remaining interval of the gate pulse width. The second width W2 is smaller than the first width W1. Thus, the second gate signal G2 includes a second slice based on the synchronization of the second slice signal SC2.

The second gate driving circuit 375 generates a pulse signal having the gate pulse width based on the synchronization of the gate clock signal CPV. The high level of the pulse signal corresponds to the gate on voltage Von, and the low level of the pulse signal corresponds to the gate off voltage Voff The second gate driving circuit 375 pulls down the pulse signal from the high level of the pulse signal to the kickback voltage Vkb in response to the second slice SC2. Thus, the second gate signal G2 comprises the high level of the second width W2 and the second slice of the second slice width CW2.

When a level of the gate signal received in a gate electrode of the switching element TR is higher, a current flowing in a drain electrode of the switching element increases. Thus, the liquid crystal capacitor CLC connected to the drain electrode of the switching element TR is charged with a high voltage, when the level of the gate signal is higher.

Therefore, the first and second gate signals G1 and G2 are controlled differently from each other in the slice width, so that the pixels corresponding to a first area in which the inverter 140 is disposed are driven to have a lower luminance than the pixels in a second area opposite to the first area. The luminance deviation of the display panel 310 caused by the inverter 140 may be removed.

Figure 7:
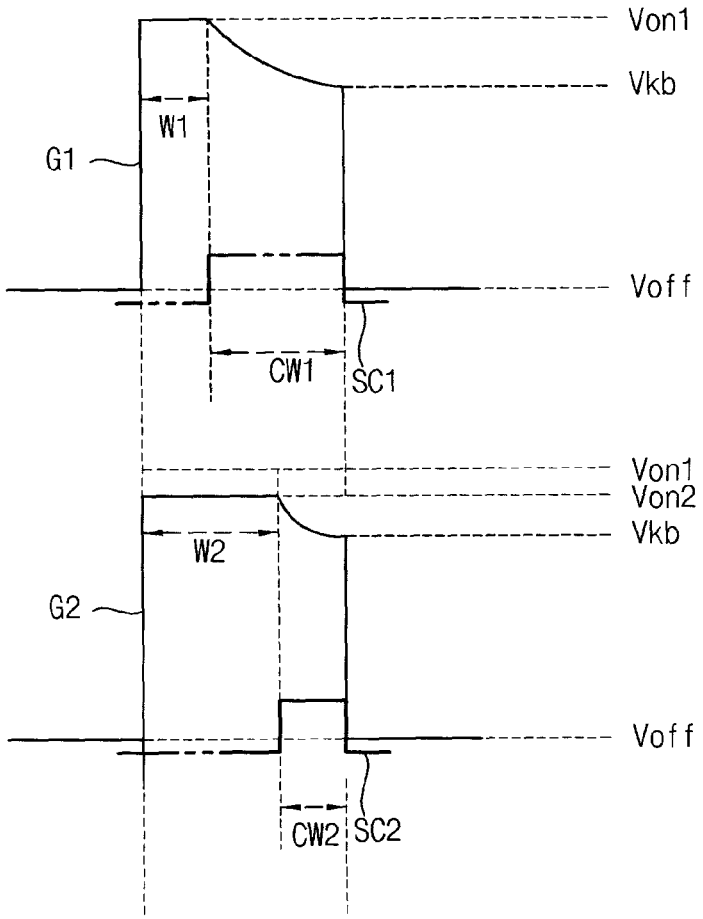
FIG. 7 is timing diagrams showing input and output signals of first and second driving circuits according to a third exemplary embodiment of the present invention.

FIG. 7 are timing diagrams showing input and output signals of first and second driving circuits according to a third exemplary embodiment of the present invention. A method of driving according to the third exemplary embodiment includes the methods of driving according to the first and second exemplary embodiments.

Referring to FIG. 3 and FIG. 7, the first gate driving circuit 355 generates a pulse signal having the gate pulse width based on the synchronization of the gate clock signal CPV. A high level of the pulse signal is determined by a level of the first gate on voltage Von1 and a low level of the pulse signal is determined by a level of the gate off voltage Voff. The first gate driving circuit 355 pulls down the pulse signal from the high level of the pulse signal to the kickback voltage Vkb in response to the first slice SC1. Thus, the first gate signal G1 comprises the first high level Von1 of the first width W1 and the first slice of the first slice width CW1.

The second gate driving circuit 375 generates the pulse signal having a set pulse width based on the synchronization of the gate clock signal CPV. A high level of the pulse signal is determined by a level of the second gate on voltage Von2 and a low level of the pulse signal is determined by a level of the gate off voltage Voff The second gate driving circuit 375 pulls down the pulse signal from the high level of the pulse signal to the kickback voltage Vkb in response to the second slice SC2. Thus, the second gate signal G2 comprises the second high level Von2 of the second width W2 and the second slice of the second slice width CW2.

The first and second gate signals G1 and G2 are controlled differently from each other in the high level and the slice width, so that the luminance deviation of the display panel 310 caused by the inverter 140 may be removed.

Therefore, the gate signal is controlled so that the charged voltage in the pixel corresponding to an area, in which the inverter is disposed, is decreased to remove the luminance deviation.

According to the present invention, a first gate signal generated from a first gate driving circuit and a second gate signal generated from a second gate driving circuit disposed corresponding to an area in which an inverter is disposed are controlled differently from each other, so that luminance deviation caused by the inverter may be removed. Therefore, the luminance uniformity of the display apparatus may be improved.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A panel assembly, comprising:

a display panel comprising a data line and a gate line extended in a direction that crosses the data line; and a panel driving apparatus comprising a first gate driving circuit that outputs a first gate signal to the gate line, and a second gate driving circuit disposed in an area that corresponds to an inverter and that outputs a second gate signal to the gate line, the second gate signal being different from the first gate signal and being applied to the gate line simultaneously with the first gate signal, wherein the first gate signal has a first voltage difference with respect to a reference voltage, and the second gate signal has a second voltage difference with respect to the reference voltage, the second voltage difference being different from the first voltage difference.

2. The panel assembly of claim 1, wherein the panel driving apparatus further comprises:

a voltage generating part that generates a first gate on voltage to output the first gate on voltage to the first gate driving circuit; and a voltage dividing part dividing the first gate on voltage and outputting a second gate on voltage to the second gate driving circuit, the second gate on voltage having a lower level than the first gate on voltage.

3. The panel assembly of claim 2, wherein the first gate driving circuit generates the first gate signal having a first high level that corresponds to the first gate on voltage and a low level that corresponds to a gate off voltage, and the second gate driving circuit generates the second gate signal having a second high level that corresponds to the second gate on voltage and the low level that corresponds to the gate off voltage, wherein the first high level is higher than the second high level.

4. The panel assembly of claim 1, wherein the panel driving apparatus further comprises:

a voltage generating part that generates a gate on voltage and outputs the gate on voltage to both the first gate driving circuit and the second gate driving circuit; and a timing control part that outputs a first slice signal to the first gate driving circuit, and that outputs a second slice signal to the second gate driving circuit.

5. The panel assembly of claim 4, wherein the first gate driving circuit generates the first gate signal having a first slice in response to the first slice signal and the first slice pulls down the first gate signal from a high level of the gate on voltage to a set voltage level, and the second gate driving circuit generates the second gate signal having a second slice in response to the second slice signal and the second slice pulls down the second gate signal from a high level of the gate on voltage to a set voltage level, wherein the width of the second slice is larger than the width of the first slice.

6. The panel assembly of claim 1, wherein a starting time of the first gate signal and the second gate signal is the same and an ending time of the first gate signal and the second gate signal is the same.

7. A panel assembly, comprising:

a display panel comprising a data line and a gate line extended in a direction that crosses the data line; and a panel driving apparatus comprising a first gate driving circuit that outputs a first gate signal having a first voltage difference with respect to a reference voltage to the gate line, and a second gate driving circuit disposed in an area that corresponds to an inverter and that outputs a second gate signal having a second voltage difference with respect to the reference voltage to the gate line, the second voltage difference being less than the first voltage difference and being applied to the gate line simultaneously with the first gate signal.

8. The panel assembly of claim 7, wherein the panel driving apparatus further comprises:

a voltage generating part that generates a first gate on voltage to output the first gate on voltage to the first gate driving circuit; and a voltage dividing part that divides the first gate on voltage and that outputs a second gate on voltage to the second gate driving circuit, the second gate on voltage being lower than the first gate on voltage.

9. The panel assembly of claim 8, wherein the panel driving apparatus further comprises a timing control part that outputs a first slice signal to the first gate driving circuit, and that outputs a second slice signal to the second gate driving circuit.

10. The panel assembly of claim 9, wherein the first gate driving circuit generates the first gate signal having a first slice in response to the first slice signal and the first slice pulls down the first gate signal from the first high level to a set voltage level, and the second gate driving circuit generates the second gate signal having a second slice in response to the second slice signal and the second slice pulls down the second gate signal from the second high level to the set voltage level, wherein the width of the first slice is larger than the width of the second slice.

11. The panel assembly of claim 7, wherein a starting time of the first gate signal and the second gate signal is the same and an ending time of the first gate signal and the second gate signal is the same.

12. A display apparatus, comprising:

a backlight assembly comprising a receiving container that receives a light source, and an inverter disposed on a rear surface of the receiving container and to provide driving power to the light source; and a panel assembly comprising a display panel having a data line and a gate line extended in a direction that crosses the data line, a first gate driving circuit that outputs a first gate signal to the gate line, and a second gate driving circuit disposed in an area that corresponds to the inverter and that outputs a second gate signal to the gate line, the second gate signal being different from the first gate signal and being applied to the gate line simultaneously with the first gate signal, wherein the first gate signal has a first voltage difference with respect to a reference voltage, and the second gate signal has a second voltage difference with respect to the reference voltage, the second voltage difference being different from the first voltage difference.

13. The display apparatus of claim 12, wherein the panel assembly further comprises:

a voltage generating part that generates a first gate on voltage to output the first gate on voltage to the first gate driving circuit; and a voltage dividing part that divides the first gate on voltage and outputs a second gate on voltage to the second gate driving circuit, the second gate on voltage being lower than the first gate on voltage.

14. The display apparatus of claim 13, wherein the first gate driving circuit generates the first gate signal having a first high level that corresponds to the first gate on voltage and a low level that corresponds to a gate off voltage, and the second gate driving circuit generates a second gate signal having a second high level that corresponds to the second gate on voltage and the low level that corresponds to the gate off voltage, wherein the first high level is higher than the second high level.

15. The display apparatus of claim 12, wherein the panel assembly further comprises:

a voltage generating part that generates a gate on voltage to output the gate on voltage to the first gate driving circuit and the second gate driving circuit; and a timing control part that outputs a first slice signal to the first gate driving circuit, and that outputs a second slice signal to the second gate driving circuit.

16. The display apparatus of claim 15, wherein the first gate driving circuit generates the first gate signal having a first slice that pulls down the first gate signal from a high level of the gate on voltage to a set voltage level in response to the first slice signal, and the second gate driving circuit generates the second gate signal having a second slice that pulls down the second gate signal from a high level of the gate on voltage to a set voltage level in response to the second slice signal, wherein the width of the second slice is larger than the width of the first slice.

17. A display apparatus, comprising:

a backlight assembly comprising a receiving container receiving a light source, and an inverter disposed on the rear surface of the receiving container and that provides driving power to the light source; and a panel assembly comprising a first gate driving circuit that outputs a first gate signal having a first voltage difference with respect to a reference voltage to the gate line, and a second gate driving circuit disposed in an area that corresponds to the inverter and that outputs a second gate signal having a second voltage difference with respect to the reference voltage to the gate line, the second voltage difference being less than the first voltage difference and being applied to the gate line simultaneously with the first gate signal.

18. The display apparatus of claim 17, wherein the panel assembly further comprises:

a voltage generating part that generates a first gate on voltage to output the first gate on voltage to the first gate driving circuit; and a voltage dividing part that divides the first gate on voltage and outputs a second gate on voltage to the second gate driving circuit, the second gate on voltage being lower than the first gate on voltage.

19. The display apparatus of claim 18, wherein the panel assembly further comprises a timing control part that outputs a first slice signal to the first gate driving circuit, and that outputs a second slice signal to the second gate driving circuit.

20. The display apparatus of claim 19, wherein the first gate driving circuit generates the first gate signal having a first slice in response to the first slice signal and the first slice pulls down the first gate signal from the first high level to a set voltage level, and the second gate driving circuit generates the second gate signal having a second slice in response to the second slice signal and the second slice pulls down the second gate signal from the second high level to a set voltage level, wherein the width of the first slice is larger than the width of the second slice.

* * * * *